US007510459B2

(12) United States Patent
Yamamoto

(10) Patent No.: US 7,510,459 B2
(45) Date of Patent: Mar. 31, 2009

(54) EYEGLASS LENS PROCESSING APPARATUS

(75) Inventor: Tadamasa Yamamoto, Gamagori (JP)

(73) Assignee: Nidek Co., Ltd., Aichi (JP)

( * ) Notice: Subject to any disclaimer, the term of this patent is extended or adjusted under 35 U.S.C. 154(b) by 45 days.

(21) Appl. No.: 11/743,320

(22) Filed: May 2, 2007

(65) Prior Publication Data

US 2007/0259604 A1 Nov. 8, 2007

(30) Foreign Application Priority Data

May 2, 2006 (JP) ..... P 2006-128694

(51) Int. Cl.
*B24B 49/12* (2006.01)
*B24B 9/14* (2006.01)

(52) U.S. Cl. ..... 451/6; 451/5; 451/43

(58) Field of Classification Search ..... 451/5, 451/42, 43, 44, 255, 256, 6, 57, 58
See application file for complete search history.

(56) References Cited

U.S. PATENT DOCUMENTS

| | | | | |
|---|---|---|---|---|
| 2,286,886 | A * | 6/1942 | Anderson | 451/43 |
| 4,503,613 | A * | 3/1985 | Yax | 451/43 |
| 5,333,412 | A | 8/1994 | Matsuyama | |
| 5,908,348 | A | 6/1999 | Gottschald | |
| 5,989,102 | A * | 11/1999 | Gottschald et al. | 451/5 |
| 6,478,657 | B1 | 11/2002 | Shibata | |
| 6,641,460 | B2 * | 11/2003 | Obayashi | 451/5 |
| 6,702,653 | B2 | 3/2004 | Shibata | |
| 6,785,585 | B1 | 8/2004 | Gottschald | |
| 6,790,124 | B2 | 9/2004 | Shibata | |
| 2001/0053659 | A1 | 12/2001 | Shibata | |

FOREIGN PATENT DOCUMENTS

| | | | |
|---|---|---|---|
| EP | 1199134 | A2 | 4/2002 |
| JP | 03135711 | A | 6/1991 |
| JP | 05111866 | A | 5/1993 |

* cited by examiner

*Primary Examiner*—Robert Rose
(74) *Attorney, Agent, or Firm*—Sughrue Mion, PLLC

(57) ABSTRACT

An eyeglass lens processing apparatus for processing an eyeglass lens, includes: a facetting tool that facets an edge corner of the lens which has been finished; a lens chuck that holds the lens; an input unit that inputs a target lens shape; a lens measuring unit that obtains front and rear edge paths of the lens, which has been finished, based on the input target lens shape; a display unit that displays a front outline graphic and a side outline graphic as view from at least one direction based on the measured front and rear edge paths; and a setting unit that sets a facetting area of the lens. The display unit displays the set facetting area in the front and side outline graphics.

8 Claims, 11 Drawing Sheets

EYEGLASS LENS PROCESSING APPARATUS

BACKGROUND OF THE INVENTION

The present invention relates to an eyeglass lens processing apparatus for processing an eyeglass lens.

There has been suggested an apparatus for facetting an edge corner of an eyeglass lens, which has been finished, to be attached to a rimless frame such as a two-points frame and a Nylor frame (see U.S. Pat. No. 6,641,460 (Japanese Unexamined Patent Publication No. 2002-126983). In such an apparatus, there are a need for an increase in efficiency of a series of processing works and particularly a need for an increase in efficiency of a processing condition setting work.

SUMMARY OF THE INVENTION

A technical object of the invention is to provide an eyeglass lens processing apparatus for efficiently setting a facetting area of an eyeglass lens.

To accomplish the above-mentioned object, the invention has the following configurations:

(1) An eyeglass lens processing apparatus for processing an eyeglass lens, the apparatus comprising:
- a facetting tool that facets an edge corner of the lens which has been finished;
- a lens chuck that holds the lens;
- an input unit that inputs a target lens shape;
- a lens measuring unit that obtains front and rear edge paths of the lens, which has been finished, based on the input target lens shape;
- a display unit that displays a front outline graphic and a side outline graphic as view from at least one direction based on the measured front and rear edge paths; and
- a setting unit that sets a facetting area of the lens,
- wherein the display unit displays the set facetting area in the front and side outline graphics.

(2) The eyeglass lens processing apparatus according to (1) further comprising a specifying unit that specifies a plurality of points for determining a boundary line of the facetting area based on at least one of the displayed front and side outline graphics,
- wherein the setting unit sets the facetting area based on the specified points.

(3) The eyeglass lens processing apparatus according to (1), wherein the setting unit sets the facetting area of a front refractive surface of the lens based on a tilt angle of the front surface of the lens at the measured front edge path position and a tilt angle of a processing surface of the facetting tool for the front surface of the lens and sets the facetting area of a rear refractive surface of the lens based on a tilt angle of the rear surface of the lens at the measured rear edge path position and a tilt angle of a processing surface of the facetting tool for the rear surface of the lens.

(4) The eyeglass lens processing apparatus according to (3), wherein the display unit displays the facetting area of the front surface of the lens and the facetting area of the rear surface of the lens with different colors.

(5) The eyeglass lens processing apparatus according to (1), wherein the display unit displays the side outline graphic with a size corresponding to a size of the front outline graphic.

(6) The eyeglass lens processing apparatus according to (1), wherein the display unit can change a view direction of the side outline graphic with respect to the front outline graphic.

(7) The eyeglass lens processing apparatus according to (1) further comprising:
- a drilling tool that drills the refractive surface of the lens; and
- an input unit that inputs a position and a diameter of a hole,
- wherein the display unit displays a hole mark in the front outline graphic based on the input position and diameter of the hole.

(8) The eyeglass lens processing apparatus according to (1) further comprising:
- a grooving tool that grooves an edge surface of the lens which has been finished; and
- an input unit that inputs a path of a groove,
- wherein the display unit displays a groove line in the side outline graphic based on the input groove path.

DESCRIPTION OF PREFERRED EMBODIMENTS

Figure 1:
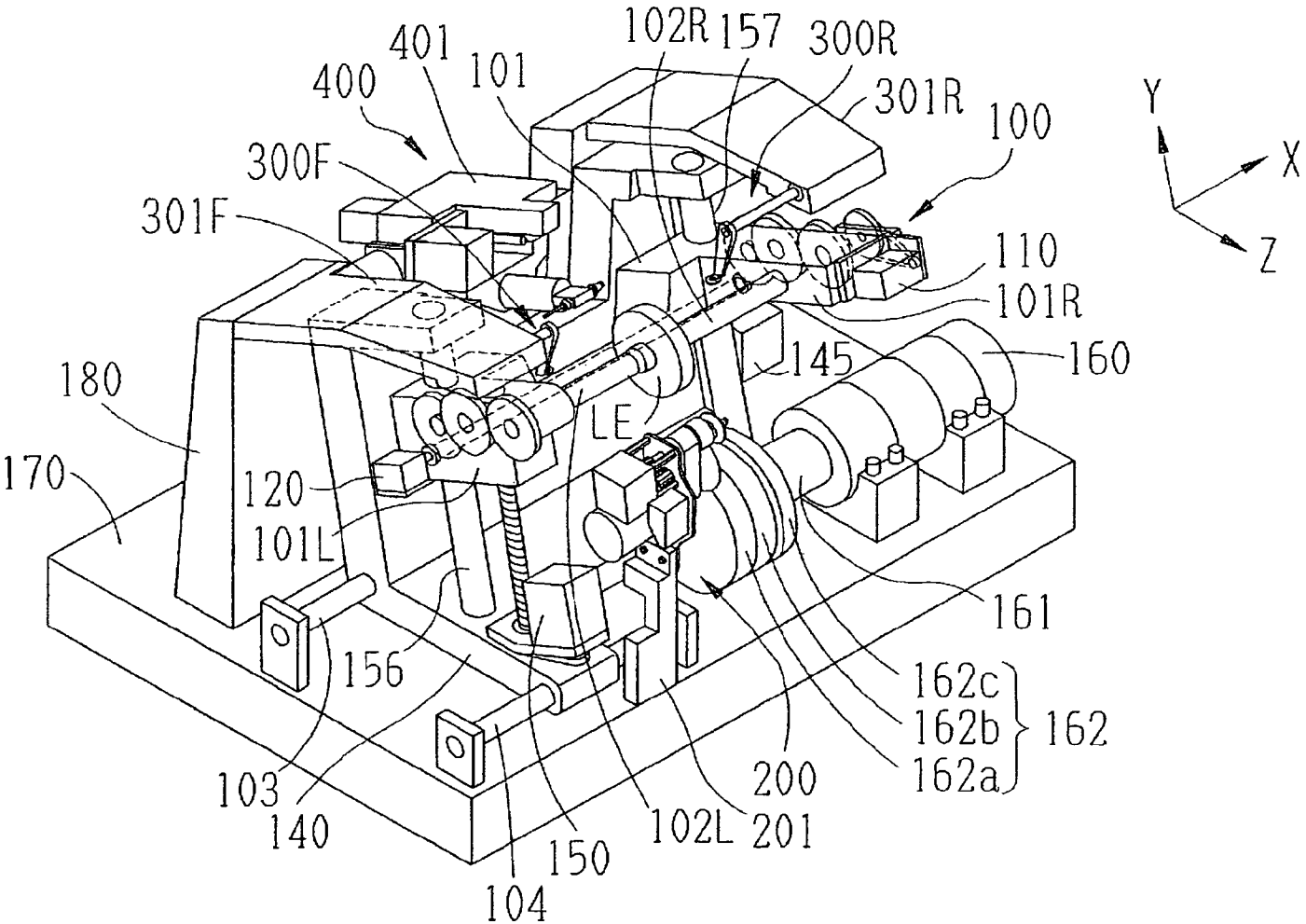
FIG. 1 is a diagram schematically illustrating a configuration of a processing (edging) portion of an eyeglass lens processing apparatus according to an embodiment of the invention.

Hereinafter, preferred embodiments of the invention will be described with reference to the drawings. FIG. 1 is a diagram schematically illustrating a processing (edging) portion of an eyeglass lens processing apparatus according to an embodiment of the invention.

A carriage portion 100 including a carriage 101 and a movement mechanism thereof is mounted on a base 170. A lens LE to be processed is held (chucked) and rotated by lens chucks 102L and 102R rotatably disposed in the carriage 101 and in processed (edged) by a grindstone 162 as a processing (edging) tool attached to a grindstone spindle 161 rotated by a grindstone rotating motor 160 fixed to the base 170. In this embodiment, the grindstone 162 includes a roughing grindstone 162*a*, a bevel-finishing and flat-finishing grindstone 162*b*, and a bevel-polishing and flat-polishing grindstone 162*c*. The grindstones 162*a* to 162*c* have the same diameter and are coaxially attached to the grindstone spindle 161.

The lens chucks 102L and 102R are held by the carriage 101 so that the center axis thereof (the rotation center axis of the lens LE) is parallel to the center axis of the grindstone spindle 161 (the rotation center axis of the grindstone 162). The carriage 101 can be moved in the direction of the center axis of the grindstone spindle 161 (the direction of the center axis of the lens chucks 102L and 102R) (an X axis direction) and can be also moved in the direction perpendicular to the X axis direction (the direction in which a distance between the center axis of the lens chucks 102L and 102R and the center axis of the grindstone spindle 161 varies) (a Y axis direction).

The lens chuck 102L and the lens shuck 102E are rotatably and coaxially held by a left arm 101L and a right arm 101R of the carriage 101, respectively. A lens holding (chucking) motor 110 is fixed to the right arm 101R and the lens chuck 102R is moved in the direction of the center axis thereof by the rotation of the motor 110. Accordingly, the lens chuck 102R is moved in the direction in which it approaches the lens chuck 102L and thus the lens LE is held (chucked) by the lens chucks 102L and 102R, A lens rotating motor 120 is fixed to the left arm 101L and the lens chucks 102L and 102R are rotated synchronously by the rotation of the motor 120, whereby the held (chucked) lens LE is rotated.

A movable support 140 is movably supported by guide shafts 103 and 104 which are fixed to the base 170 so as to extend parallel to each other in the X axis direction. An X axial movement motor 145 is fixed to the base 170. The support 140 is moved in the X axis direction by the rotation of the motor 145 and the carriage 101 supported by guide shafts 156 and 157 fixed to the support 140 is moved in the X axis direction.

The carriage 101 is movably supported by the guide shafts 156 and 157 which are fixed to the support 140 so as to extend parallel to each other in the Y axis direction. A Y axial movement motor 150 is fixed to the support 140 and the carriage 101 moves in the Y axis direction by the rotation of the motor 150.

Figure 2:
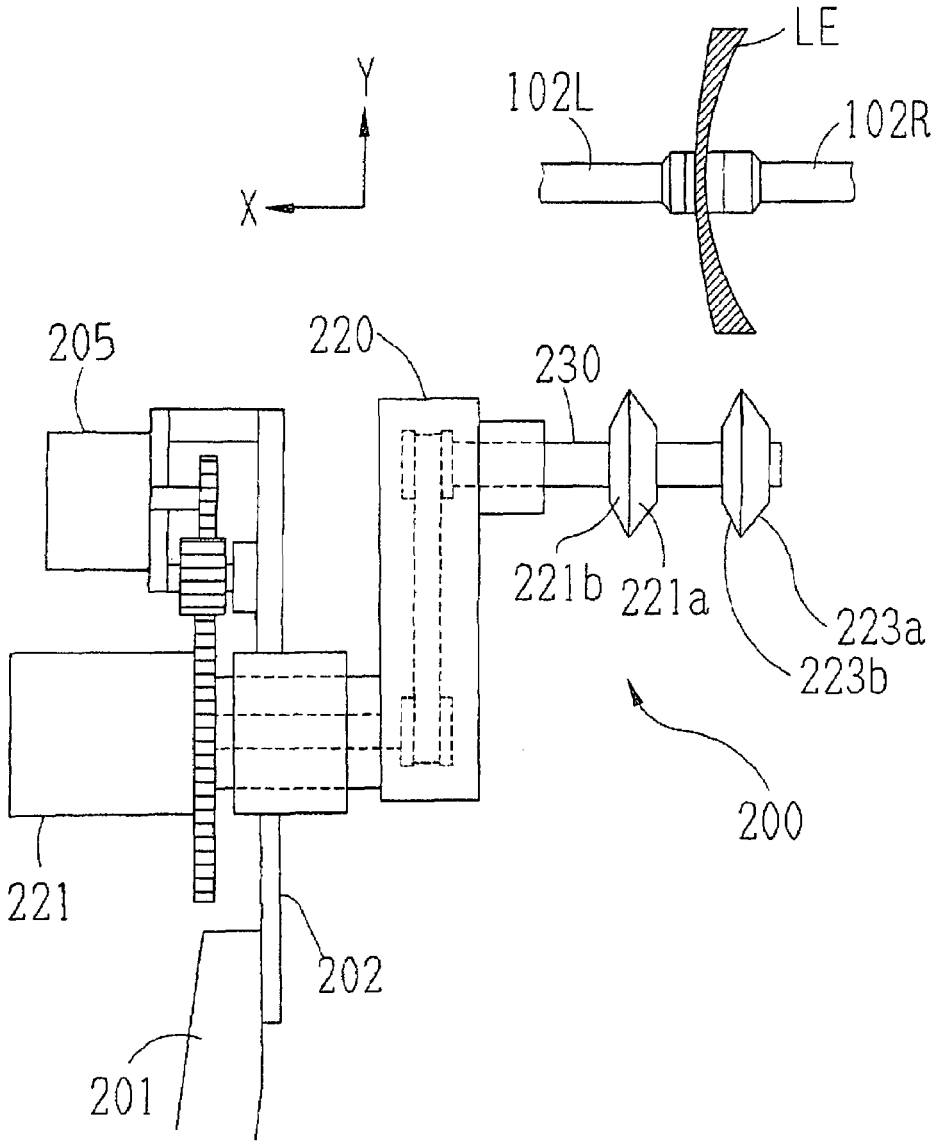
FIG. 2 is a diagram schematically illustrating a configuration of a chamfering portion.

A chamfering portion 200 is disposed in front of the carriage portion 100. FIG. 2 is a diagram schematically illustrating the chamfering portion 200. An arm 220 is rotatably held by a plate 202 fixed to a fixed support 201 on the base 170. A finish-chamfering grindstone 221*a* for a front refractive surface (hereinafter, referred to as a front surface) of the lens LE, a finish-chamfering grindstone 221*b* for a rear refractive surface (hereinafter, referred to as a rear surface) of the lens LE, a polish-chamfering grindstone 223*a* for the front surface of the lens LE, and a polish-chamfering grindstone 223*b* for the rear surface of the lens LE are coaxially attached to a grindstone spindle 230 rotatably held by the arm 220. The grindstones 221*a*, 221*b*, 223*a*, and 223*b* have the same diameter, the processing surfaced of the grindstones 221*a* and 223*a* have the same tilt angle, and the processing surfaces of the grindstones 221*b* and 223*b* have the same tilt angle. A grindstone moving motor 205 is fixed to the plate 202 and the arm 220 is rotated by the rotation of the motor 205, whereby the grindstone spindle 230 is moved between a retreat position and a processing position. The processing position of the grindstone spindle 230 is located in a plane defined between the lens chucks 102R and 102L and the grindstone spindle 161 by both center axes. A grindstone rotating motor 221 is fixed to the arm 220 and the grindstone spindle 230 is rotated by the rotation of the motor 221.

In this embodiment, the grindstones 221*a*, 221*b*, 223*a*, and 223*b* as a chamfering tool are used as a facetting tool in a facetting process to be described later. Alternatively, an endmill may be used as the facetting tool.

Figure 3:
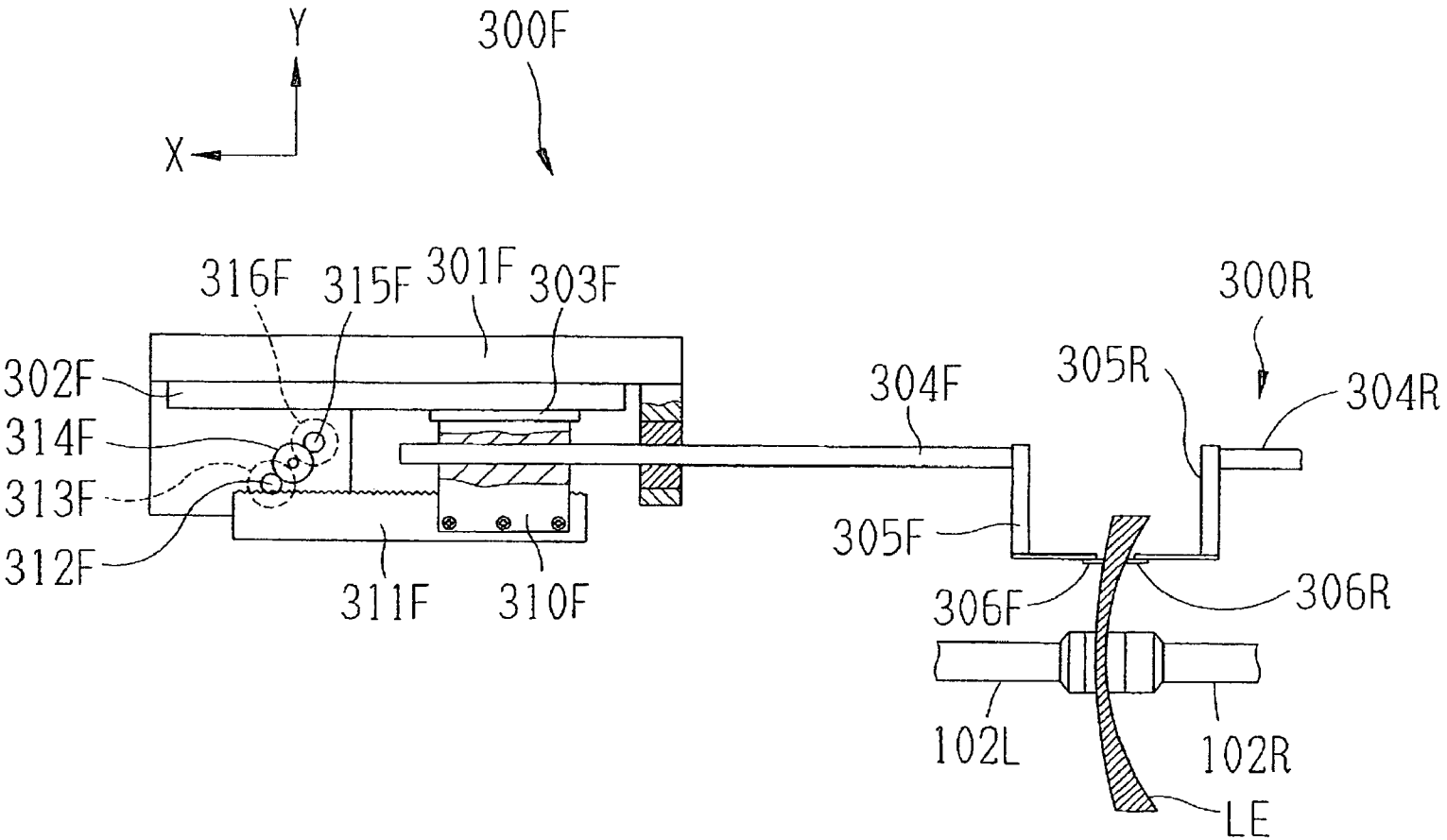
FIG. 3 is a diagram schematically illustrating a configuration of a lens measuring portion.

Lens measuring portions 300F and 300R are disposed above the carriage 100. FIG. 3 is a diagram schematically illustrating the lens measuring portion 300F for measuring the front shape (a front edge path after the finishing process) of the lens LE, A guide rail 302F extending in the X axis direction is fixed to a fixed support 301F fixed to a stand 180 on the base 170 and a slider 303F to which a movable support 310F is fixed is movably supported onto the guide rail 302F. A tracing stylus arm 304F is fixed to the support 310F, an L-shaped tracing stylus hand 305F is fixed to the end of the arm 304F, and a disc-shaped tracing stylus 306F is fixed to the end of the hand 305F. The tracing stylus 306F comes in contact with the front surface of the lens LE at the time of measuring the front shape of the lens LE.

A rack gear 311F is fixed to the lower portion of the support 310F and a gear 312F attached to the rotation shaft of an encoder 313F fixed to the support 301F is engaged with the rack gear 311F. A lens measuring motor 316F is fixed to the support 301F and the rotation of the motor 316F is transmitted to the rack gear 311F through a gear 315F attached to the rotation shaft of the motor 316F, a gear 314F, and the gear 312F, whereby the rack gear 311F, the support 310F, the arm 304F, and the like are moved in the X axis direction. Curing the measurement, the motor 316F presses the tracing stylus 306F onto the front surface of the lens LS with a constant force. The encoder 313F detects the displacement of the support 310F (the position of the tracing stylus 306F) in the X axis direction. The front shape of the lens LE is measured from the displacement (position) and the rotation angles of the lens chucks 102L and 102R.

Figure 4:
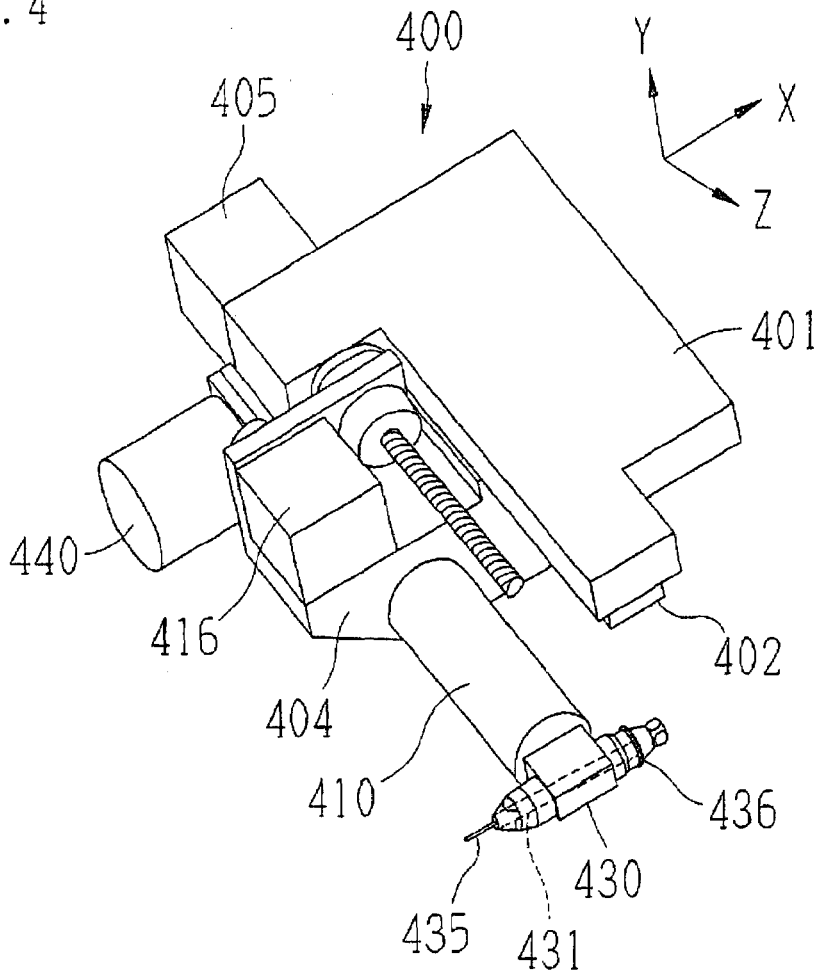
FIG. 4 is a diagram schematically illustrating a configuration of a drilling and grooving portion.

The lens measuring portion 300R for measuring the rear shape (a rear edge path after the finishing process) of the lens LE is symmetric with the lens measuring portion 300F and thus description thereof is omitted, A drilling and grooving portion 400 is disposed in back of the carriage portion 100. FIG. 4 is a diagram schematically illustrating the drilling and grooving portion 400. A guide rail 402 extending in a Z axis direction (the direction perpendicular to the XY plane) is fixed to a fixed support 401 fixed to the stand 180 and a slider which is not shown but to which a movable support 404 is fixed is movably supported on the guide rail 402. A Z axial movement motor 405 is fixed to the support 401 and the support 404 is moved in the Z axis direction by the rotation of the motor 405. A rotating support 410 is rotatably held by the support 404. A holder rotating motor 416 is fixed to the support 404 and the support 410 is rotated about its center axis by the rotation of the motor 416.

A processing tool holder 430 for holding a processing tool is disposed at the end of the support 410. The holder 430 is moved in the Z axis direction by the movement of the support 404 by the motor 405 and is rotated by the rotation of the support 410 by the rotation of the motor 416. A rotation shaft 431 having the center axis perpendicular to the center axis of the support 410 is rotatably held by the holder 430, an endmill 435 as a drilling tool is attached to the one end of the shaft 431, and a grooving cutter (or grindstone) 436 as a grooving tool is attached to the other end thereof. An endmill and cutter rotating motor 440 is faxed to the support 404 and the shaft 431 is rotated by the rotation of the motor 440, whereby the endmill 435 and the cutter 436 attached to the shaft 431 are rotated.

The configurations of the carriage portion 100, the lens measuring portions 300F and 300R, and the drilling and grooving portion 400 are basically the same as described in U.S. Pat. No. 6,790,124 Japanese Unexamined Patent Publication No. 2003-145328). The configuration of the chamfering portion 200 is basically the same as described in U.S. Pat. No. 6,478,657 (Japanese Unexamined Patent Publication 2001-18155).

Figure 5:
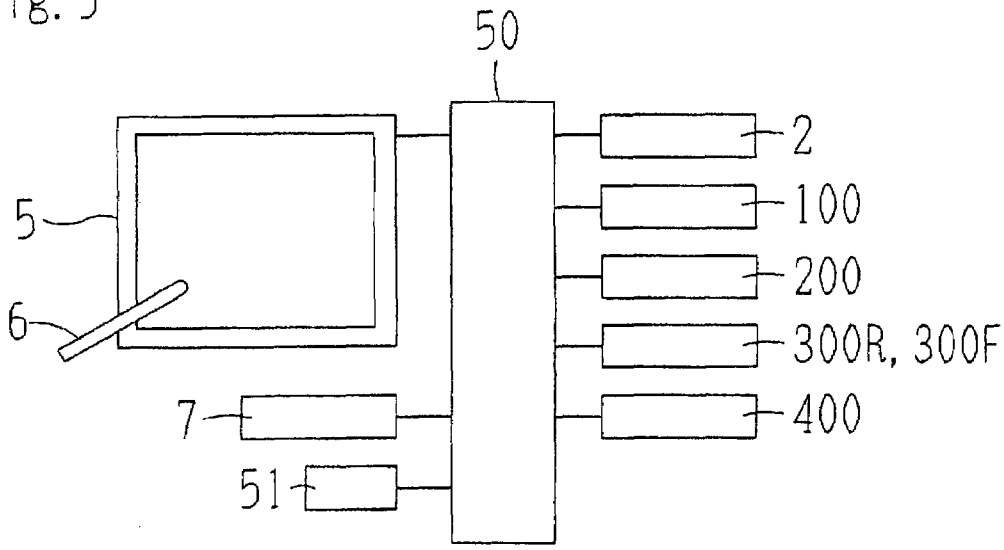
FIG. 5 is a block diagram schematically illustrating a control system of the eyeglass lens processing apparatus.

FIG. 5 is a diagram schematically illustrating a control system of the eyeglass lens processing apparatus. An eyeglass frame measuring device 2 (as which the device described in U.S. Pat. No. 5,333,412 (Japanese Unexamined Patent Publication No. 4-93164) and the like can be used), a touch screen type display (hereinafter, referred to as a touch panel) 5 as a display portion and an input portion, a switch portion 7, a memory 51, the carriage portion 100, the chamfering portion 200, the lens measuring portions 300F and 300R, and the drilling and grooving portion 400 are connected to an operation controller 50. The display unit and the input unit may be separate from each other, instead of being commonly used with the touch panel.

Operations of the apparatus having the above-mentioned configuration, mainly a setting operation for facetting process on the lens attached to a rimless frame or the like, are described.

The shapes of right and left rims of an eyeglass frame are measured by the measuring device 2, thereby obtaining target lens shape data. In the rimless frame, the shape of a template (pattern) thereof, the shape of a dummy lens (demo lens, model lens), and the like are measured, thereby obtaining the target lens shape data. The target lens shape data (Rn, θn) (where n=1, 2, . . . , N) from the measuring device 2 is input and stored in the memory 51 by pressing a communication button displayed on the touch panel 5. Rn indicates a radial length from a geometrical center of the target lens shape and θn indicates a radial angle. When the target lens shape data is input, a front outline graphic FT based on the target lens shape data is displayed on the screen of the touch panel 5 (see FIG. 6). By manipulating buttons displayed on the touch panel 5 with a stylus pen 6 (a finger may be used instead), layout data such as a frame pupillary distance (FPD) of the frame, a pupillary distance (PD) of a wearer of the frame, and a height of an optical center of the lens from the geometrical center of the target lens shape are input. The two-point frame is set as a type of the eyeglass frame and the facetting is set as an additional process. The target lens shape data may be input from a database not shown.

When the two-point frame is set, the roughing, the flat-finishing, and the drilling are performed as a standard process. When a full-rim frame is set, the roughing and the bevel-finishing are performed as the standard process. When a Nylor frame is set, the roughing, the flat-finishing, and the grooving are performed as the standard process. The polishing, the chamfering and/or the facetting can be set as the additional process. When the facetting is set, the polishing is automatically performed. The processes may be set individually.

Figure 6:
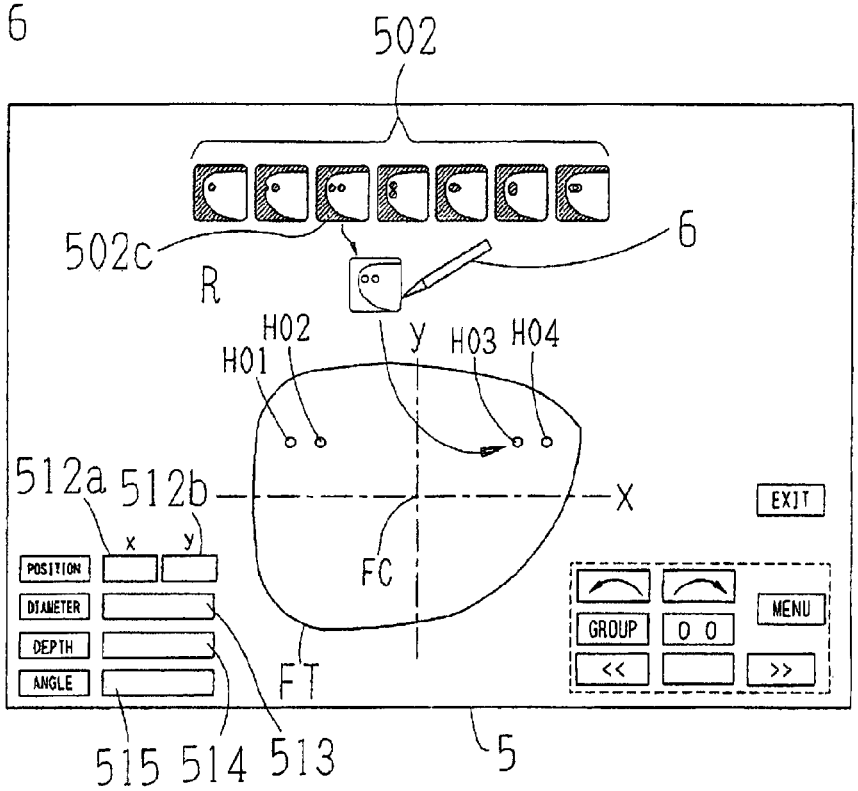
FIG. 6 is a diagram illustrating an example of a screen for inputting hole data.

When the two-points frame is set, a hole data input screen is displayed on the touch panel 5. FIG. 6 is a diagram illustrating an example of the hole data input screen displayed on the touch panel 5. By specifying (selecting) (clicking) an icon 502*c* having, for example, a pattern in which two round through holes are arranged in the horizontal direction with the pen 6, from plural kinds of hole pattern icons 502 registered in advance and moving (dragging and dropping) the icon 502*c* to a desired position on the ear side or nose side in the front outline graphic FT, hole positions H01, H02, H03, and H04 are simultaneously set. The hole positions may be set by inputting numerals to an x axial position field 512*a* and a y axial position field 512*b*. The hole positions are managed as positions in the xy plane with a geometrical center FC of the target lens shape as a reference.

The hole diameter is set by inputting numerals to a hole diameter field 513, the hole depth is set by inputting numerals to a hole depth field 514, and the hole angle (direction) is set by inputting numerals to a hole angle field 515.

When necessary data such as the hole data are input, the lens LE is held (chucked) by the lens chucks 102L and 102R and a processing start switch of the switch portion 7 is pressed to operate the apparatus. The operation controller 50 controls the lens measuring portions 300F and 300R on the basis of the input target lens shape data to measure the shape of the lens LE. The operation controller 50 drives the motor 316F to locate the arm 304F at a measuring position from a retreat position, drives the motor 150 to move the carriage 101 in the Y axis direction and drives the motor 316F to move the arm 304F toward (in the direction getting close to) the lens LE on the basis of the target lens shape data, and then brings the tracing stylus 306F into contact with the front surface of the lens LE. The operation controller drives the motor 120 to rotate the lens LE with the tracing stylus 306F in contact with the front surface and drives the motor 150 to move the carriage 701 in the Y axis direction on the basis of the target lens shape data. With the rotation and movement of the lens LE, the tracing stylus 306F is moved in the center axis direction of the lens chucks 102L and 102R (the X axis direction) along the front shape of the lens LE. The moved amount is detected by the encoder 313F and the front shape (Rn, θn, zn) (where n=1, 2, . . . , N) of the lens LE is measured. Here, zn denotes a position in the X axis direction of the front surface of the lens LE. The rear shape of the lens LE is also measured by the lens measuring portion 300R. Data on the measured front and rear shapes (front and rear edge paths) of the lens LE are stored in the memory 51.

A front position corresponding to the hole position (including the middle position between two arranged hole positions) and a front position located inwardly or outwardly by a predetermine distance from the hole position are measured and the tilt angle of the front surface of the lens LE is measured, and the measured front positions and the measured tilt angle are stored in the memory 51.

Figure 7:
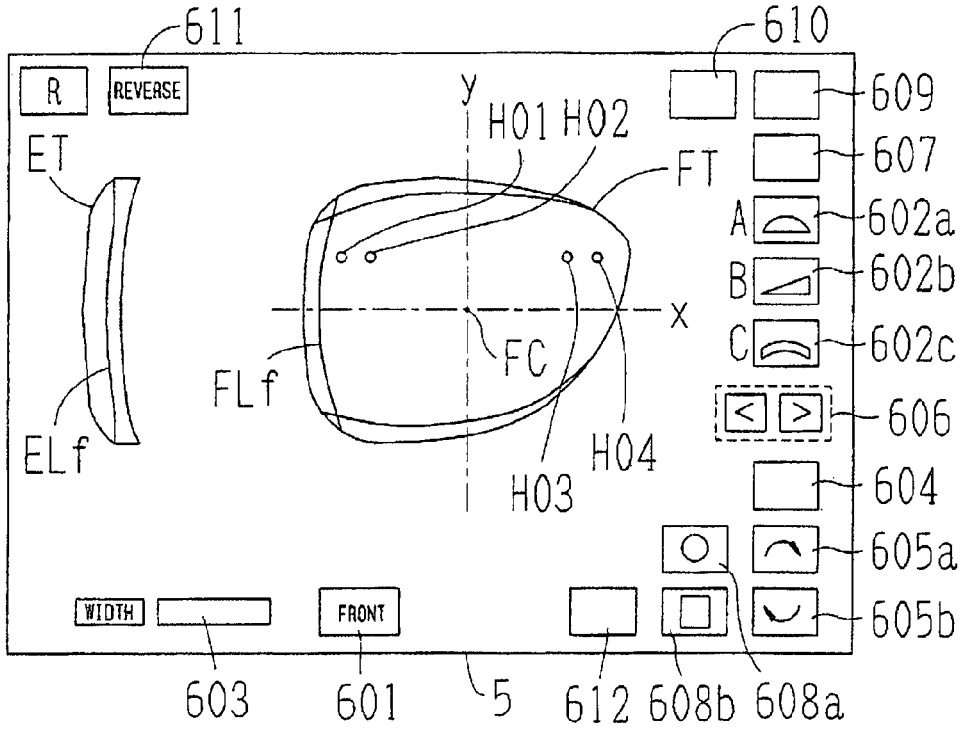
FIG. 7 is a diagram illustrating an example of a screen for setting a lens area (facetting area) to be facetted.

When the measurement result of the lens measuring portions 300F and 300R is obtained, a screen for setting a lens area (hereinafter, referred to as a facetting area) which is subjected to the facetting process is displayed on the touch panel 5. FIG. 7 is a diagram illustrating an example of the facetting area setting screen displayed on the touch panel 5. The specification (selection) of the front or rear surface of the lens LE is performed by manipulating a button 601. FIG. 7 shows an example where the front surface of the lens LE is specified.

A side outline graphic ET as viewed from the left side in the x axis direction is displayed with a size corresponding to a size of the front outline graphic FT on the left side of the front outline graphic FT based on the target lens shape data. The side outline graphic ET is calculated and displayed on the basis of the front and rear shape data of the lens LE obtained on the basis of the target lens shape data.

The operation of setting the facetting area is described with reference to the case where the facetting area is selected from plural kinds of facetting styles registered in advance.

Figure 8A:
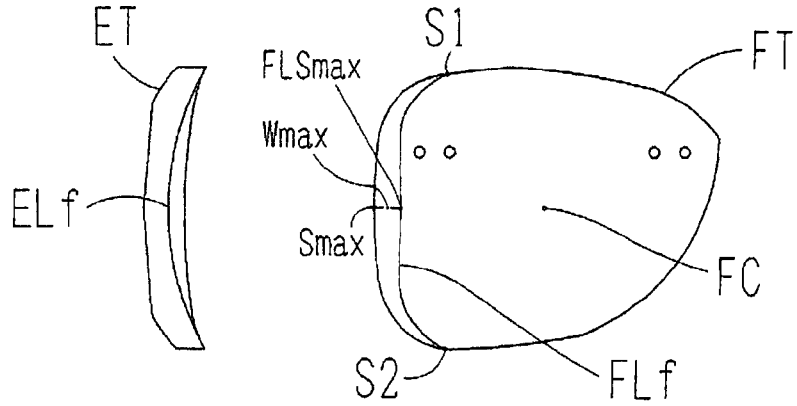
FIGS. 8A to 8E are diagrams illustrating an operation of setting the facetting area.

FIG. 8A is a diagram illustrating an example of the front outline graphic FT and the side outline graphic ET when a facetting style A is specified by a button 602*a*. When points S1 and S2 and point Smax at which a processing width W is the maximum, in the middle therebetween are specified on the outline of the front outline graphic FT by the pen 6, point FLSmax which is located inwardly (toward the center FC) apart by the maximum processing width Wmax in the normal direction from the point Smax is set. Then, the point S1, the point FLSmax, and the point S2 are joined with a curved line to set a facetting line FLf so that the processing width W gradually increases from the point S1 to the point Smax (the point FLSmax) and the processing width W gradually decreases from the point Smax (the point FLSmax) to the point S2, and the facetting line FLf is marked in the front outline graphic FT. A facetting line ELf is also set on the basis of the facetting line FLf and is marked in the side outline graphic ET. In this embodiment, the variation rate of the processing width W is calculated on the basis of a sinusoidal function, but may be calculated on the basis of a natural logarithm, an involute function, and the like.

Figure 8B:
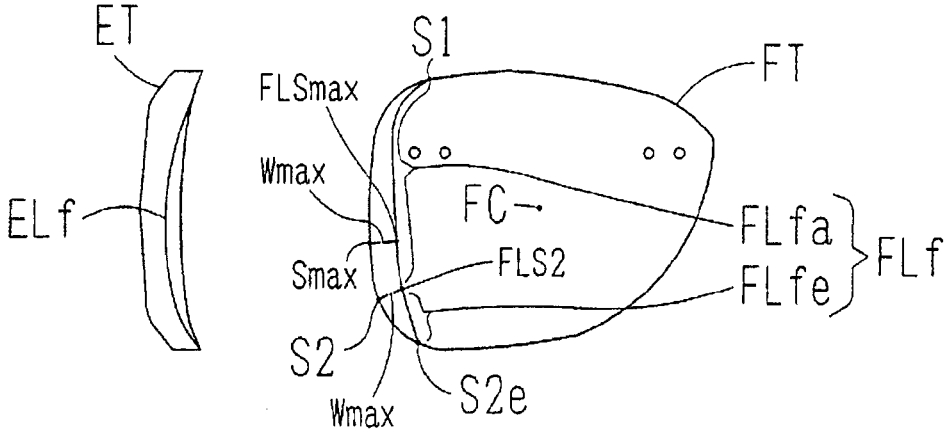

FIG. 8B is a diagram illustrating an example of the front outline graphic FT and the side outline graphic ET when a facetting style B is specified by a button 602*b*. When points S1 and S2 and point Smax at which a processing width W is the maximum in the middle therebetween are specified on the outline of the front outline graphic FT by the pen 6, point FLSmax which is located inwardly apart by the maximum processing width Wmax in the normal direction from the point Smax and point FLS2 which is located inwardly apart by the maximum processing width Wmax in the normal direction from the point S2 are set. Then, the point S1, the point FLSmax, and the point FLS2 are joined with a curved line to set a facetting line FLfa so that the processing width W gradually increases from the point S1 to the point Smax (the point FLSmax) and the maximum processing width Wmax is maintained from the point Smax (the point FLSmax) to the point S2 (the point FLS2), and the facetting line FLfa is marked in the front outline graphic FT. Point S2*e* at which a tangent line at the vicinity of the point FLS2 on the facetting line FLfa meets the outline is set, and the point FLS2 and the point S2*e* are joined with a straight line to set a facetting line FLfe and is marked in the front outline graphic FT. A facetting line ELf is also set on the basis of the facetting lines FLfa and FLfe and is marked in the side outline graphic ET.

Figure 8C:
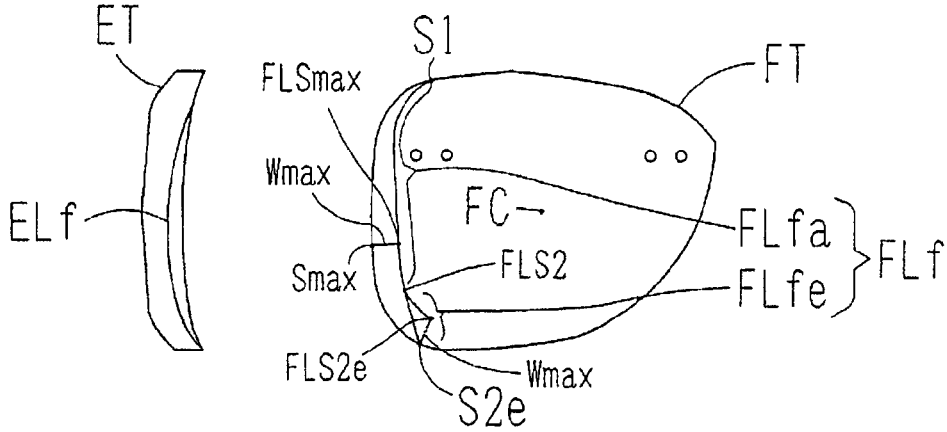

Another setting method of the facetting style B is described with reference to FIG. 8C. When point S1, point Smax, and point S2*e* are specified on the outline of the front outline graphic FT by the pen 6, point FLSmax which is located inwardly apart by the maximum processing width Wmax in the normal direction from the point Smax and point FLS2*e* which is located inwardly apart by the maximum processing width Wmax in the normal direction from the point S2*e* are set. Point FLS2 at which a curved line joining the point FL Smax and the point FL S2*e* meets a straight line passing through the point s2*e* is set. Then, the point S1, the point FLSmax, and the point FLS2 are joined with a curved line to set a facetting line FLfa and the point FLS2 and the point S2*e* are joined with a straight line to set a facetting line FLfe, so that the processing width W gradually increases from the point S1 to the point Smax (the point FLSmax) and the maximum processing width W is maintained from the point Smax (the point FLSmax) to the point FLS2. The facetting lines FLfa and FLfe are marked in the front outline graphic FT. A facetting line ELf is also set on the basis of the facetting lines FLfa and FLfe and is marked in the side outline graphic ET.

Incidentally, in the facetting style B, the point Smax may not be designated. In this case, the processing width W is gradually increased from the point S1 to the point S2 (the point PLS2).

Figure 8D:
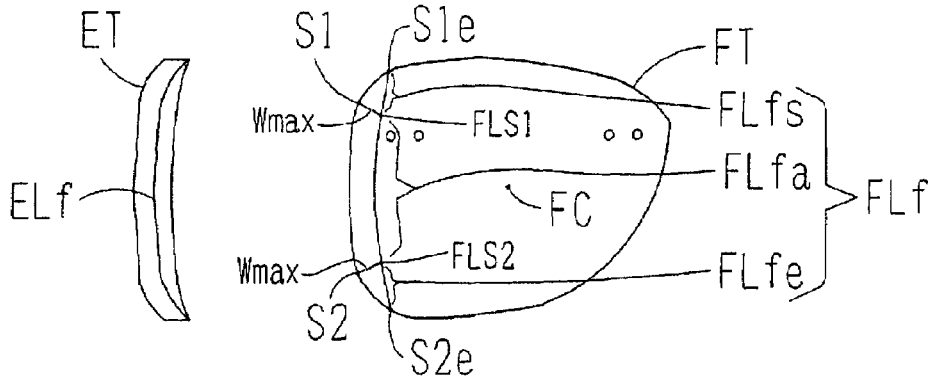

FIG. 8D is a diagram illustrating an example of the front outline graphic FT and the side outline graphic ET when a facetting style C is specified by a button 602*c*. When points S1 and S2 are specified on the outline of the front outline graphic FT by the pen 6, point FLS1 which is located inwardly apart by the maximum processing width Wmax in the normal direction from the point S1 and point FLS2 which is located inwardly apart by the maximum processing width Wmax in the normal direction from the point S2 are set. Then, the point FLS1 and the point FLS2 are joined with a curved line to set a facetting line FLfa so that the maximum processing width Wmax is maintained from the point S1 (the point FLS1) to the point S2 (the point FLS2), and the facetting line FLfa is marked in the front outline graphic RT. Point S1*e* at which a tangent line at the vicinity of the point FLS1 on the facetting line FLfa meets the outline is set, the point FLS1 and the point S1*e* are joined with a straight line to set a facetting line FLfs, and the facetting line FLfs is marked in the front outline graphic FT. Point S2*e* at which a tangent line at the vicinity of the point FLS2 on the facetting line FLfa meets the outline is set, the point FLS2 and the point S2*e* are joined with a straight line to set a facetting line FLfe, and the facetting line FLfe is marked in the front outline graphic FT. A facetting line ELf is also set on the basis of the facetting lines FLfa, FLfs and FLfe and is marked in the side outline graphic ET.

Figure 8E:
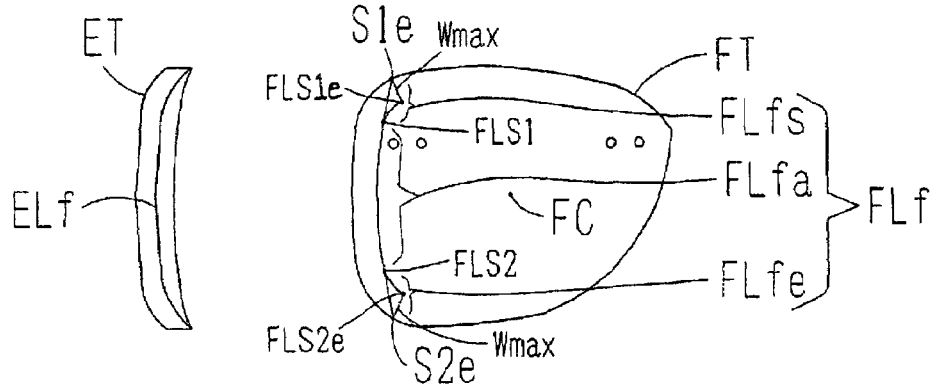

Another setting method of the facetting style C is described with reference to FIG. 8E. When points S1*e* and S2*e* are specified on the outline of the front outline graphic FT by the pen 6, point FLS1*e* which is located inwardly apart by the maximum processing width Wmax in the normal direction from the point S1*e* and point FLS2*e* which is located inwardly apart by the maximum processing width Wmax in the normal direction from the point S2*e* are set. Point FLS1 at which a curved line joining the point FL S1*e* and the point FL S2*e* meets a straight line passing through the point S1*e* and Point FLS2 at which the curved line joining the point FL S1*e* and the point FL S2*e* meets a straight line passing through point S2*e* are set. Then, the point FLS1 and the point FLS2 are joined with a curved line to set a facetting line FLfa so that the maximum processing width Wmax is maintained from the point FLS1 to the point FLS2, the point FLS1 and the point S1*e* are joined with a straight line to set a facetting line FLfs, the point FLS2 and the point S2*e* are joined with a straight line to set a facetting line FLfe. The facetting lines FLfa, FLfs and FLfe are marked in the front outline graphic FT. A facetting line ELf is also set on the basis of the facetting lines FLfa, FLfs, and FLfe and is marked in the side outline graphic ET.

The maximum processing width Wmax is set by inputting numerals to a processing width field 603. The maximum processing width Wmax may be also set by inputting numerals such as a processing width T (see FIG. 9) in an edge thickness which can be obtained from the front and rear shapes of the lens LE.

Figure 9:
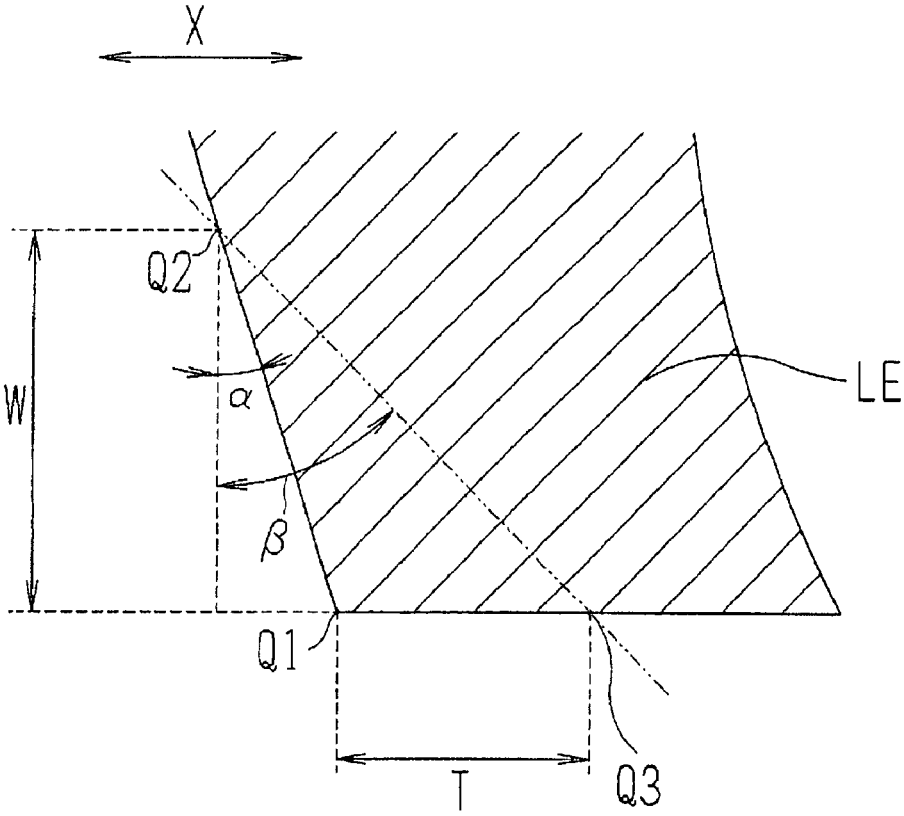
FIG. 9 is a diagram illustrating an operation of calculating boundary lines (facetting lines) of the facetting area.

Next, an operation of calculating the facetting line ELf based on the facetting line FLf set in the front outline graphic FT is described with reference to FIG. 9. FIG. 9 shows an examples where the front surface of the lens LE is specified. It is assumed that a distance from a front edge (edge path) position Q1 of the lens LE to a facetting point Q2 on the front surface is W, a distance from the front edge position Q1 to a facetting point Q3 on the edge surface (side surface) is T, a tilt angle of the front surface at the front edge position Q1 is $\alpha$, and a tilt angle of the processing surface of the grindstones 221*a* and 223*a* for the front surface is $\beta$. The tilt angle $\alpha$ can be obtained by measuring the front edge position Q1 after the finishing process and a front position inwardly or outwardly apart by a predetermined distance from the front edge position Q2. The tilt angle $\beta$ of the processing surface of the grindstones 221*a* and 221*b* for the front surface (also a tilt angle of the processing surface of the grindstones 221*b* and 223*b* for the rear surface) is stored in advance in the memory 51.

When the processing width W is set, the processing width T is obtained by $T=W\times(\tan\beta-\tan\alpha)$. The position of the facetting point Q3 relative to the front edge position Q1 can be obtained from the obtained processing width T. By performing the calculation every small radial angle, the facetting line Elf on the basis of the facetting line FLf can be obtained.

Incidentally, in the case that the processing with T is set, the processing width W can be obtained by $W=T\times(\tan\beta-\tan\alpha)$. Accordingly, the position of the facetting point Q2 relative to the front edge position Q1 can be obtained from the obtained processing width W, thereby obtaining the facetting line FLf on the basis of the facetting line ELf.

The facetting areas can be set plurally. When a plurality of facetting areas are set, a facetting line during setting is marked by red color and a facetting line after setting is marked by blue color. When a facetting line opposite thereto is set already, the corresponding facetting line is marked by black color.

Figure 10A:
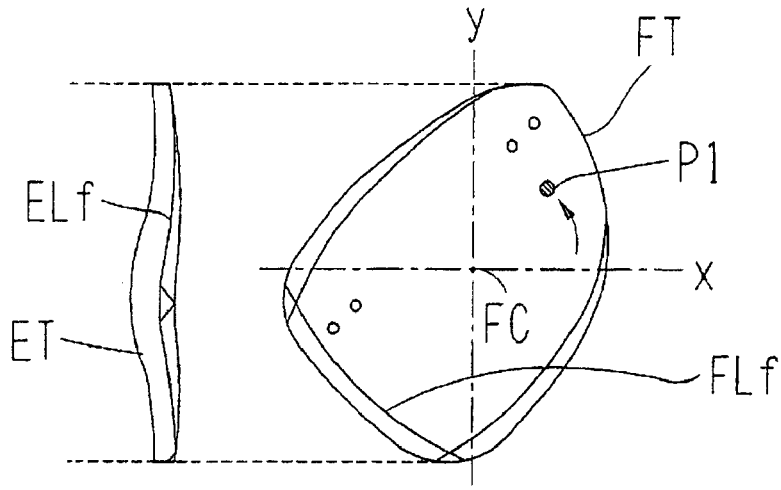
FIGS. 10A and 10B are diagram illustrating an operation of displaying a front outline graphic and a side outline graphic based on target lens shape data.

When it is intended to change the side outline graphic ET to a state viewed in another direction, a side outline graphic changing mode is started by manipulating a button 604. For example, as shown in FIG. 10A, when any point P1 inside or outside the front outline graphic FT is specified by the pen 6 and is rotated about the center FC, the front outline graphic FT and the facetting line FLf are displayed as being rotated about the center FC and the side outline graphic ET and the facetting line ELf as viewed from the left side in the x axis direction are displayed with a size corresponding to a size of the front outline graphic FT.

Figure 10B:
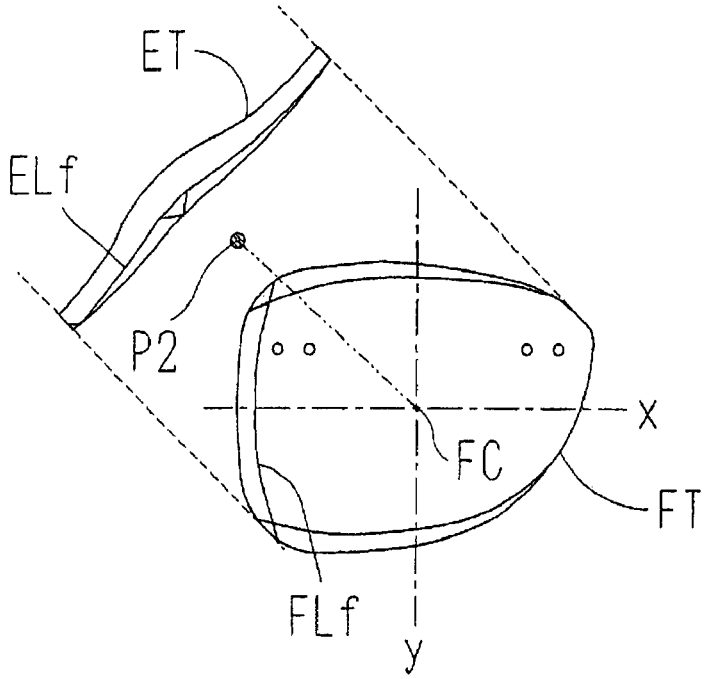

For example, as shown in FIG. 10B, when any point p2 inside or outside the fixed and displayed front outline graphic FT is specified by the pen 6, the side outline graphic ET and the facetting line ELf as viewed from the left side in an axis direction connecting the center FC and the point P2 are displayed with a size corresponding to a size of the front outline graphic FT.

The front outline graphic FT and/or the side outline graphic ET may be rotated by manipulating buttons 605*a* and 605*b*. The graphics are rotated to right by manipulating the button 605*a* and are rotated to left by manipulating the button 605*b*. The graphics may be rotated by inputting numerals. The rotation center of the front outline graphic FT and/or the side outline graphic ET may be not the center FC.

The side outline graphic ET may be displayed as viewed in several directions. For example, the side outline graphics ET may be displayed plurally as viewed from both sides with the front outline graphic FT. It is enough so long as the side outline graphic ET as viewed from at least one side is displayed in parallel with the front outline graphic FT.

With the display of the front outline graphic FT and the side outline graphic ET in the above manner, the facetting area can be set properly.

In the facetting area setting screen, hole marks are displayed in the front outline graphic FT on the basis of the hole positions and the hole diameter input through the hole data input screen. Accordingly, it is possible to visually grasp the relation between the facetting area and the holes and it is also possible to easily determine whether the operation of setting the facetting area is appropriate. For example, when the facetting line FLf extends over the hole marks, the holes and the facetting area interfere with each other the holes are formed in the facetting area). Accordingly, the setting of the facetting area and/or the holes should be changed.

When the setting of the facetting area is changed, the positions of the points S1, S2, Smax, S1*e* and/or S2*e* are changed. In addition, the processing width W or T is changed. When the setting of the facetting line FLf is deleted, the facetting line FLf to be deleted is specified by the pen 6 (or a button 606) and is deleted by manipulating a button 607.

When a display magnification of the front outline graphic FT and the side outline graphic ET is changed to confirm the facetting area in detail, the display magnification is changed in the order of 1.5 times, 2 times, 1 times, 1.5 times, . . . by manipulating an button 608*a*. In addition, numerals of the display magnification can be input by the use of a numerical pad displayed by the manipulation of a button 608*b*.

When data on the set facetting area is stored, the facetting area data is stored in the memory 51 along with the target lens shape data by the manipulation of a button 609. The data stored in the memory 51 can be read by manipulating a button 610. Accordingly, the same facetting area can be set in the same target lens shape. When a plurality of facetting area data corresponding to one target lens shape data are stored, a desired facetting area can be selected and set.

The facetting area data may be stored in the memory 51 independently of the target lens shape data and may be applied to a target lens shape different from (but similar to) the target lens shape when the facetting area is set. Accordingly, it is possible to efficiently set the facetting area.

Regarding the target lens shape data, the other target lens shape data can be obtained by inverting one target lens shape data of right and left target lens shape data, and the same is true of the facetting area. That is, when one facetting area of right and left facetting areas is set, the other facetting area is set by manipulating a button 611. This is because the right and left target lens shapes of the rimless frame have the inverted shape of the opposite target lens shape. Accordingly, the facetting area is more efficiently set compared with the case where the facetting areas of the right and left sides are set separately from each other and the left and right facetting areas have similarity.

When the target lens shape data is enlarged or reduced about the center FC, the facetting area data is also enlarged or reduced accordingly.

The operation of setting the facetting area may be performed subsequent to the operation of inputting the hole data. In this case, since the shape of the lens LE is not measured yet, a temporary side outline graphic ET is displayed on the basis of the target lens shape data, a predetermined front surface curvature and a predetermined rear surface curvature, and the facetting area is set on the basis of the front outline graphic FT on the basis of the target lens shape data and the temporary side outline graphic ET. After the lens LE is measured, a true side outline graphic ET on the basis of the front and rear shape data of the lens LE obtained from the target lens shape data and the previously set facetting area are displayed and the facetting area can be adjusted properly.

When the facetting area is set, a processing start switch of the switch portion 7 is pressed and the apparatus operates. The operation controller 50 first moves the carriage 101 (lens LE) in the Y axis direction on the basis of the target lens shape data and performs the roughing using the grindstone 162*a*, the flat-finishing using the grindstone 162*b*, and the flat-polishing using the grindstone 162*c*. Next, when the front facetting is performed, the operation controller moves the carriage 101 (lens LE) in the X and Y axis directions on the basis of the front facetting data and performs the front facetting using the grindstones 221*a* and 223*a*. When the rear facetting is performed, the operation controller moves the carriage 101 (lens LE) in the X and Y axis directions on the basis of the rear facetting date and performs the rear facetting using the grindstones 221*b* and 223*b*.

Another example for easily setting the facetting area is described. FIGS. 11A to 11F show examples where, when paints S1 and S2 are specified in the front outline graphic FT by the pen 6, a line passing through point FLc positioned on the facetting line FLf joining the point S1 and the point s2 is set to any one of a straight line and a curved line. When a line type change mode is started by manipulating a button 612, a button for selecting one of the straight line pattern and the curved line pattern is displayed instead of the buttons 602*a* to 602*c*. In the line type change mode, when the points S1 and S2 are specified, a middle point on the straight line joining the point S1 and the point S2 is automatically set as the point FLc (see FIG. 11A).

Figure 11A:
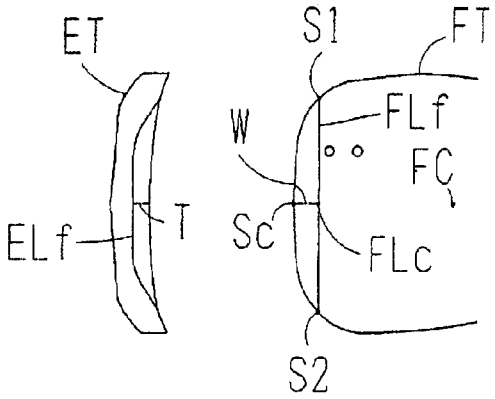
FIGS. 11A to 11F are diagrams illustrating an operation of setting the facetting area.
Figure 11B:
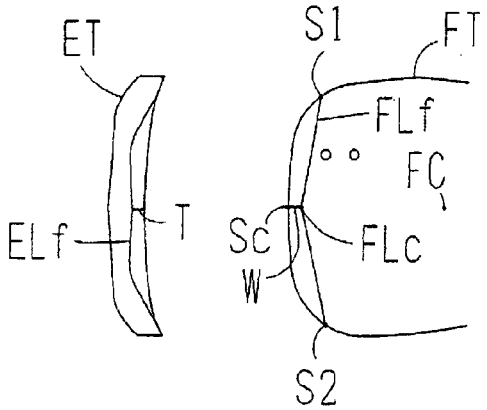
Figure 11C:
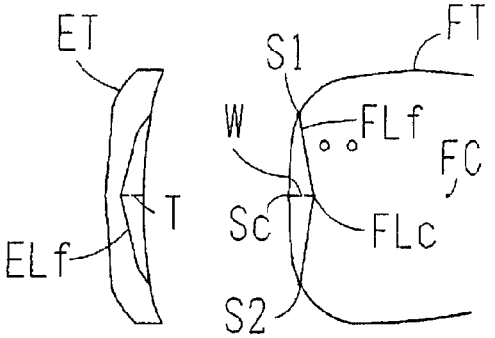
Figure 11D:
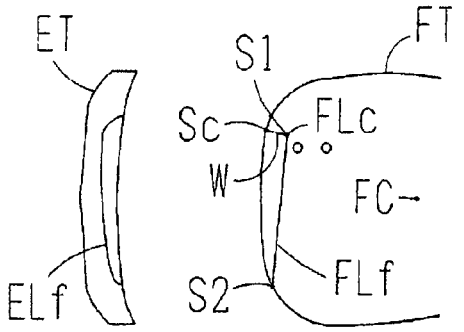

When the straight line pattern is specified and the point FLc is moved within the front outline graphic FT by the pen 6, a line joining the point S1 and the point FLc and a line joining the point S2 and the point FLc are set as a straight line (see FIGS. 11B and 11D). The sate is true in the case where the point S1 and/or the point S2 is moved within the front outline graphic FT (see FIG. 11C).

Figure 11E:
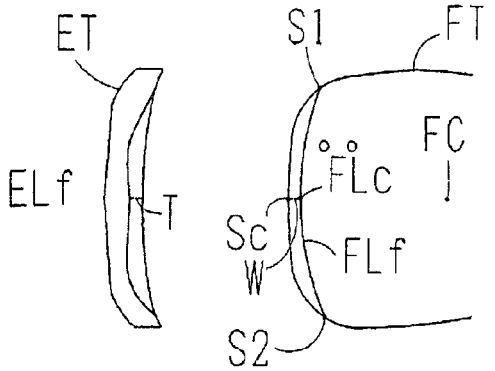
Figure 11F:
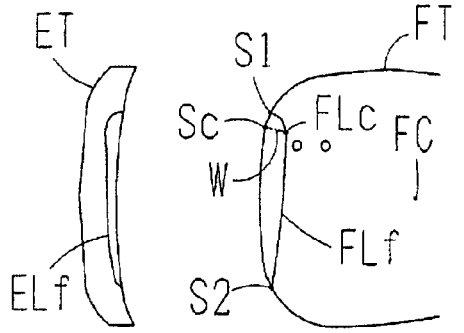

When the curved line pattern is specified and the point FLc is moved within the front outline graphic FT by the pen 6, a line joining the point S1 and the point FLc and a line joining the point S2 and the point FLc are set as a curved line (see FIG. 11E). The same is true in the case where the point S1 and/or the point S2 is moved within the front outline graphic FT (see FIG. 11F).

In this case, since the side outline graphic ET and the facetting line ELf are displayed, it is possible to properly set the facetting area. Since the hole marks are also displayed, it is possible to properly set the facetting area. Since the front outline graphic FT and/or the side outline graphic ET can be rotated and displayed, it is possible to properly set the facetting area.

The point FLc may be set by inputting numerals of the processing width W or T from point Sc on the outline of the front outline graphic FT between the point S1 and the point S2 to the processing width field 603. The point FLc (the point Sc corresponding thereto) can be set plurally between the point S1 and the point S2.

Figure 12:
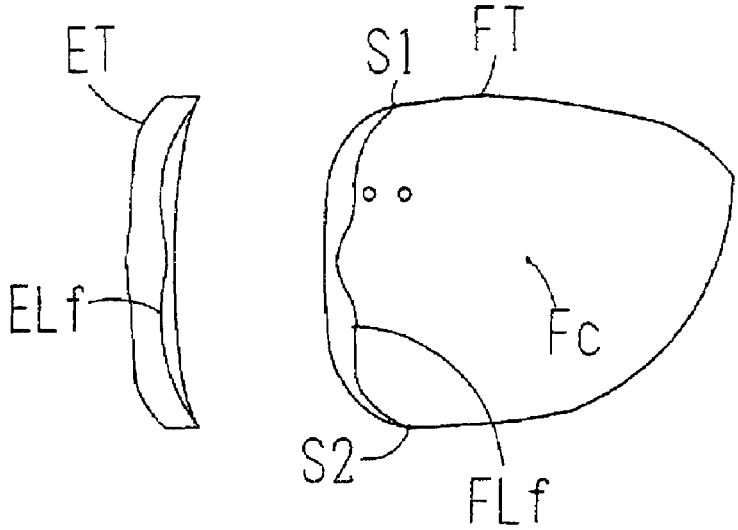
FIG. 12 is a diagram illustrating an operation of setting the facetting area.

Another example for easily setting the facetting area is described. When the point (position) is set and moved within the front outline graphic FT from the point S1 to the point S2 in the front outline graphic FT by the pen 6, the facetting line FLf is set by allowing the operation controller 50 to perform a smoothing operation using a spline interpolation to the path (a set of plural points) drawn by the pen 6 (see FIG. 12). In this case, the side outline graphic ET and the facetting line ELf are displayed. The hole marks are displayed. The front outline graphic FT and/or the side outline graphic ET can be rotated and displayed.

The front outline graphic FT and/or the side outline graphic ET can be also displayed when the bevel-finishing process or the grooving process is set. When the bevel-finishing process is set, the operation controller 50 calculates the bevel-finishing data on the basis of the target lens shape data and the front and rear shape data of the lens LE. The bevel-finishing data can be obtained, for example, by disposing a bevel apex path on the entire periphery of the edge surface so that the edge thickness which can be obtained from the front and rear shapes of the lens LE is divided with a predetermined ratio. The front outline graphic and the side outline graphic are displayed on a bevel-finishing data screen and a bevel line indicating the bevel apex path is displayed in the side outline graphic. The front outline graphic and/or the side outline graphic can be rotated and displayed.

When the grooving process is set, the operation controller 50 calculates the grooving data on the basis of the target lens shape data and the front and rear shape data of the lens LE. The grooving data can be obtained, for example, by disposing a groove center path on the entire periphery of the edge surface so that the edge thickness which can be obtained from the front and rear shapes of the lens LE is divided with a predetermined ratio. The front outline graphic and the side outline graphic are displayed on a grooving data screen and a groove line indicating the groove center path is displayed in the side outline graphic. The front outline graphic and/or the side outline graphic can be rotated and displayed.

Figure 13:
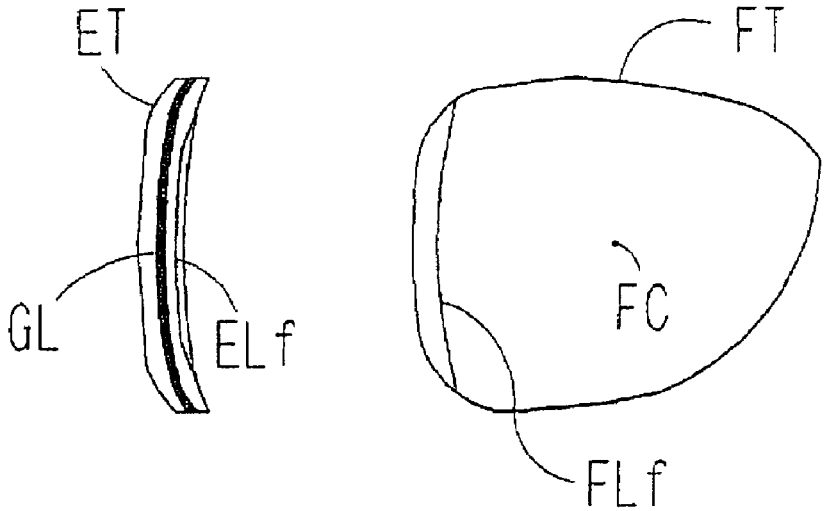
FIG. 13 is a diagram illustrating a relation between a groove and the facetting area.

When the facetting process is set in addition to the grooving process, first, the grooving data is obtained and the groove line GL indicating the groove center path is displayed in the side outline graphic ET on the facetting area setting screen (see FIG. 13). Accordingly, it is possible to visually grasp the relation between the facetting area and the groove and it is also possible to easily determine whether the facetting area is properly set. For example, when the facetting line FLf extends over the groove line, the groove and the facetting area interfere with each other. Accordingly, the setting of the facetting area and/or the groove should be changed.

Although the apparatus configuration in which the facetting area setting device and the eyeglass lens processing apparatus are incorporated in a body has been described above, they may have individual configurations. For example, the facetting area setting device may have the touch panel and the operation controller and may be combined with the eyeglass frame measuring device. In this configuration, the temporary side outline graphic is displayed on the basis of the target lens shape data obtained by the eyeglass frame measuring device and predetermined front and rear surface curvatures and the facetting area is set on the basis of the front outline graphic based on the target lens shape data and the temporary side outline graphic. Then, the target lens shape data and the set facetting area data are input to the eyeglass lens processing apparatus. In the eyeglass lens processing apparatus, the lens measuring portions are controlled on the basis of the input target lens shape data so as to measure the front and rear shapes of the lens. After measuring the shapes, the true side outline graphic based on the front and rear shape data of the lens obtained on the basis of the target lens shape data and the previously set facetting area are displayed and then the facetting area can be properly adjusted.

What is claimed is:

1. An eyeglass lens processing apparatus for processing an eyeglass lens, the apparatus comprising:

a facetting tool that facets an edge corner of the lens which has been finished;

a lens chuck that holds the lens;

an input unit that inputs a target lens shape;

a lens measuring unit that obtains front and rear edge paths of the lens after finishing processing based on the input target lens shape;

a display unit that displays a front outline graphic and a side outline graphic as view from at least one direction based on the measured front and rear edge paths; and a setting unit that sets a facetting area of the lens, wherein the display unit displays the set facetting area in the front and side outline graphics.

2. The eyeglass lens processing apparatus according to claim 1 further comprising a specifying unit that specifies a plurality of points for determining a boundary line of the facetting area based on at least one of the displayed front and side outline graphics, wherein the setting unit sets the facetting area based on the specified points.

3. The eyeglass lens processing apparatus according to claim 1, wherein the setting unit sets the facetting area of a front refractive surface of the lens based on a tilt angle of the front surface of the lens at the measured front edge path position and a tilt angle of a processing surface of the facetting tool for the front surface of the lens and sets the facetting area of a rear refractive surface of the lens based on a tilt angle of the rear surface of the lens at the measured rear edge path position and a tilt angle of a processing surface of the facetting tool for the rear surface of the lens.

4. The eyeglass lens processing apparatus according to claim 3, wherein the display unit displays the facetting area of the front surface of the lens and the facetting area of the rear surface of the lens with different colors.

5. The eyeglass lens processing apparatus according to claim 1, wherein the display unit displays the side outline graphic with a size corresponding to a size of the front outline graphic.

6. The eyeglass lens processing apparatus according to claim 1, wherein the display unit can change a view direction of the side outline graphic with respect to the front outline graphic.

7. The eyeglass lens processing apparatus according to claim 1 further comprising:

a drilling tool that drills the refractive surface of the lens; and an input unit that inputs a position and a diameter of a hole, wherein the display unit displays a hole mark in the front outline graphic based on the input position and diameter of the hole.

8. The eyeglass lens processing apparatus according to claim 1 further comprising:

a grooving tool that grooves an edge surface of the lens which has been finished; and an input unit that inputs a path of a grooves, wherein the display unit displays a groove line in the side outline graphic based on the input groove path.

* * * * *